US005417192A

United States Patent [19]

Choi et al.

[11] Patent Number: 5,417,192

[45] Date of Patent: May 23, 1995

[54] AUTOMATIC IDLING-UP CONTROLLING DEVICE OF AN ENGINE AND A METHOD FOR MAKING THE SAME

[75] Inventors: Taewoo Choi, Kyungsangnam-do; Dongsu Kim, Chungcheongnam-do, both of Rep. of Korea

[73] Assignee: Hyundai Motor Company, Seoul, Rep. of Korea

[21] Appl. No.: 177,473

[22] Filed: Jan. 5, 1994

[30] Foreign Application Priority Data

Jul. 20, 1992 [KR] Rep. of Korea ..... 92-12919

[51] Int. Cl.[6] ..... F02M 9/08

[52] U.S. Cl. ..... 123/339.22

[58] Field of Search ..... 123/339, 325; 62/133, 62/228.4, 209

[56] References Cited

U.S. PATENT DOCUMENTS

| | | | |
|---|---|---|---|
| 5,136,997 | 8/1992 | Takahashi et al. | 123/339 |
| 5,199,272 | 4/1993 | Yamanaka et al. | 62/133 |
| 5,203,300 | 4/1993 | Orzel | 123/339 |
| 5,235,946 | 8/1993 | Fodale et al. | 123/339 |
| 5,235,947 | 8/1993 | Watanabe | 123/339 |
| 5,253,626 | 10/1993 | Hatano et al. | 123/352 |
| 5,265,570 | 11/1993 | Schnaibel et al. | 123/339 |
| 5,265,571 | 11/1993 | Sodeno | 123/339 |
| 5,289,807 | 3/1994 | Yonekawa | 123/325 |
| 5,320,077 | 6/1994 | Kamiya et al. | 123/339 |
| 5,345,908 | 9/1994 | Nishimura et al. | 123/339 |

*Primary Examiner*—Raymond A. Nelli

*Attorney, Agent, or Firm*—Birch, Stewart, Kolasch & Birch

[57] ABSTRACT

The present invention discloses an automatic idling-up controlling device of an engine including: a vehicle speed sensing member for sensing a running speed of a vehicle and producing a corresponding signal; an engine coolant temperature sensing member for sensing an engine coolant temperature and producing a corresponding signal; an engine rotation frequency sensing member for sensing a rotation frequency of an engine; a controller connected to the vehicle speed sensing member, engine coolant temperature sensing member and engine rotation frequency sensing member and producing a control signal to increase an injected quantity of a fuel, if a warming-up action is necessary, by determining a state of the engine by of an engine coolant and an engine rotation frequency when the vehicle is halted; and an actuator controlling member connected to the controller and varying by a controlling signal applied to the controller to vary a quantity of a fuel injected to an inside of a cylinder of the engine.

2 Claims, 2 Drawing Sheets

AUTOMATIC IDLING-UP CONTROLLING DEVICE OF AN ENGINE AND A METHOD FOR MAKING THE SAME

BACKGROUND OF THE INVENTION

Field of the Invention

The present invention relates to a warming-up action of an engine that is carried out to protect the engine before a car starts to run after the engine starts. More particularly, it relates to an automatic idling-up controlling device and a method for making the device. The automatic idling-up controlling device increases a frequency of idling rotation of the engine to reduce a noxious gas generated when an accelerating pedal is operated to accelerate a warming-up action for heating the engine after the engine starts.

Description of the Prior Art

A warming-up action for heating an engine of a car for a predetermined time after the engine starts, is carried out in order that the engine of the car is protected and each engine of the car runs smoothly before a driver starts the car. Further, the warming-up operation is carried out quickly by increasing the fuel quantity flowing into the engine. Therefore, since the state of the engine is raised to an optimum temperature, abrasion of the engine that may occur by unreasonable operation and other problems that may occur by the action of the cooled engine can be prevented. As a conventional method for smooth operation of the engine, a driver uses an accelerating pedal to control the fuel quantity injected to the engine and perform a quickly warming-up action.

That is, the driver sets a car, and after a predetermined time goes by, the action of the accelerating pedal is controlled by means of the accelerating pedal or an adjusting screw connected to the accelerating pedal so as to heat the engine to an optimum temperature that can operate the engine normally within a short time by enhancing the rotation speed of the engine. Therefore, the fuel quantity supplied to the engine is increased in order that the engine can operate more actively. The engine is heated actively by the warmth generated by the operation of the engine, with the rotation frequency of the engine being increased. The warming-up action whereby the engine is heated to a normal state is further accelerated to enhance the efficiency of the engine speed.

In the case where the engine is warmed-up, the state of the engine is not exactly determined, and the car is warmed up by operating the accelerating pedal just by driving experience of the driver.

Accordingly, the car may start before the full warming-up action, and immoderation is put on the engine whereby the corresponding system of the engine is abraded or each engine may be out of order. Further, if the adjusting screw used is not converted into an initial state by an error of the driver, the engine operates by the rotation frequency adjusted by the action of the adjusting screw during the driving of the car.

Even though the warming-up action of the engine is completed, if the driver does not figure out the state of the engine exactly and tries to continue the warming-up action by means of the accelerating pedal, the rotation frequency of the engine is abruptly increased by the operation of the accelerating pedal to exhaust a noxious gas of imperfect combustion.

SUMMARY OF THE INVENTION

An object of the present invention is to solve the conventional problems identified above. According to an automatic idling-up controlling device of an engine in the present invention, the exact warming-up action may be automatically performed by precisely sensing the state of the engine, using the temperature of a coolant. Thus, fuel can be saved and there can be prevented troubles by the excessive operation of the engine.

It is another object of the present invention to reduce a noxious gas produced by the rotation frequency of the engine increased abruptly by sensing the continuous operation of an accelerating pedal after a warming-up action is performed to automatically be in an idling rotation state of the engine.

In order to achieve these objects, the present invention comprises:

- a vehicle speed sensing means for sensing a running speed of a vehicle and producing a corresponding signal;
- an engine coolant temperature sensing means for sensing an engine coolant temperature and producing a corresponding signal;
- an engine rotation frequency sensing means for sensing a rotation frequency of an engine;
- a controller connected to the vehicle speed sensing means, engine coolant temperature sensing means and engine rotation frequency sensing means and producing a control signal to increase an injected quantity of a fuel, if a warming-up action is necessary, by determining a state of the engine by means of an engine coolant and an engine rotation frequency when the vehicle is halted; and
- an actuator controlling means connected to the controller and varying by a controlling signal applied to the controller to vary a quantity of a fuel injected to an inside of a cylinder of the engine.

In order to achieve the above objects, the present invention provides a method for automatically controlling an idling-up of an engine comprising the steps of:

- reading whether a running speed of a vehicle is "0" or not and reading whether an engine coolant temperature is higher than a given temperature;
- outputting a controlling signal for operating an actuator controlling means when a running speed of a vehicle is "0" and an engine coolant temperature is lower than a given temperature;
- outputting a controlling signal for operating an actuator controlling means when a rotation frequency of the engine is larger than a given value of an engine rotation frequency, after reading whether the rotation frequency of the engine is larger than the given value of the engine rotation frequency, if the engine coolant temperature is higher than a given temperature; and
- halting an operation of the actuator controlling means when an operation time of the actuator controlling means is longer than a given time, and operating the actuator controlling means until the running speed of the vehicle is not "0" when the operation time of the actuator controlling means is shorter than the given time.

DETAILED DESCRIPTION OF THE PREFERRED EMBODIMENTS

Figure 1:
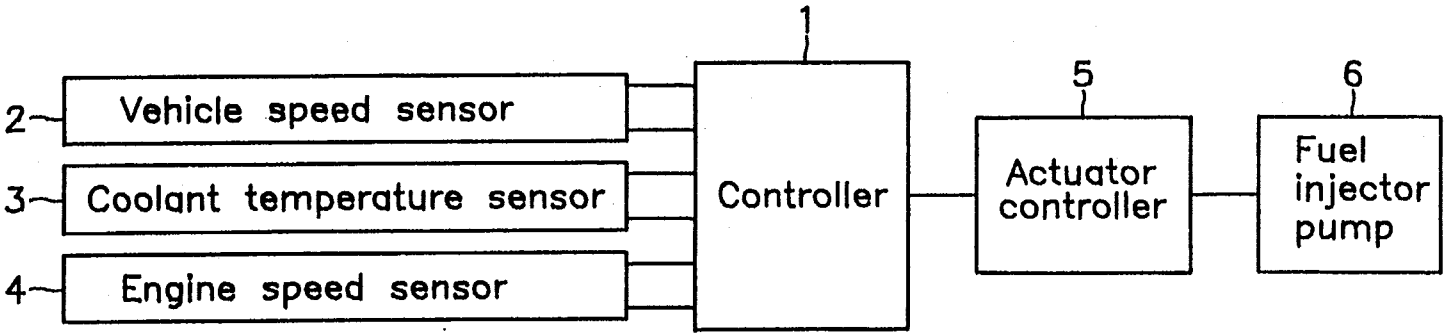
FIG. 1 is a block diagram of an automatic idling-up controlling device of an engine in accordance with a preferred embodiment of the present invention.

Referring to FIG. 1, the present invention includes a vehicle speed sensor 2 for outputting a corresponding electrical signal by sensing the driving speed of a vehicle; a coolant temperature sensor 3 for outputting a corresponding electrical signal by sensing a temperature of an engine coolant; an engine rotation frequency sensor 4 for outputting a corresponding electrical signal by sensing a rotation frequency of the engine; a controller 1 for outputting a corresponding control signal in accordance with an operational state of the vehicle connected to the vehicle speed sensor 2, the coolant; temperature sensor 3, and the engine rotation frequency sensor 4; an actuator controller 5 connected to the controller 1 to control fuel quantity flowing into the engine in accordance with a controlling signal applied from the controller 1; and a fuel injection pump 6 connected to the actuator controller 5 to control the fuel quantity injected from an outlet.

The operation of the invention will now be described referring to the drawings.

First, a setting action is performed by receiving a signal corresponding to a speed of the vehicle, a temperature of the engine coolant and rotation frequency of the engine from the vehicle speed sensor 2 and the coolant temperature sensor 3 connected to the controller 1. The controller 1 outputs a corresponding controlling signal to the actuator controller 5 to control the action of a plunger for controlling an opening degree of an outlet of the fuel injection pump 6 to perform the warming-up action of the engine enough to meet a predetermined initial requirement.

After completing the warming-up action to be in the idling rotation, an actuator is operated to be in a predetermined state to increase the rotation frequency of the engine thereby, so as to prevent an imperfect combustion of fuel generated by the abrupt increase of the rotation frequency of the engine when the accelerating pedal is operated by the driver.

The time for warming up the engine is reduced and the warming-up state is determined according to the state of the engine to avoid performing an unnecessary warming-up action. Accordingly, the time or the fuel can be saved. If a predetermined time that is enough to perform the; warming-up action of the engine is over, the warming-up action is automatically converted to the idling rotation of the engine so that the fuel can be reduced.

Further, when the accelerating pedal is operated to accelerate the warming-up action during the idling rotation, the rotation frequency of the engine increases for a predetermined time. Thus, imperfect combustion of the engine produced by the abrupt increase of the rotation frequency of the engine may be reduced, and a noxious gas produced at this stage may be also reduced.

As the actuator operated by a control signal of the actuator controller, a conventional actuator connected to an air-conditioner switch (not illustrated) used for operating the air-conditioner is applied to the embodiment of the present invention. Accordingly, a system that controls the action of the conventional actuator without a supplementary apparatus is used for the present invention such that the production cost can be saved.

Figure 2:
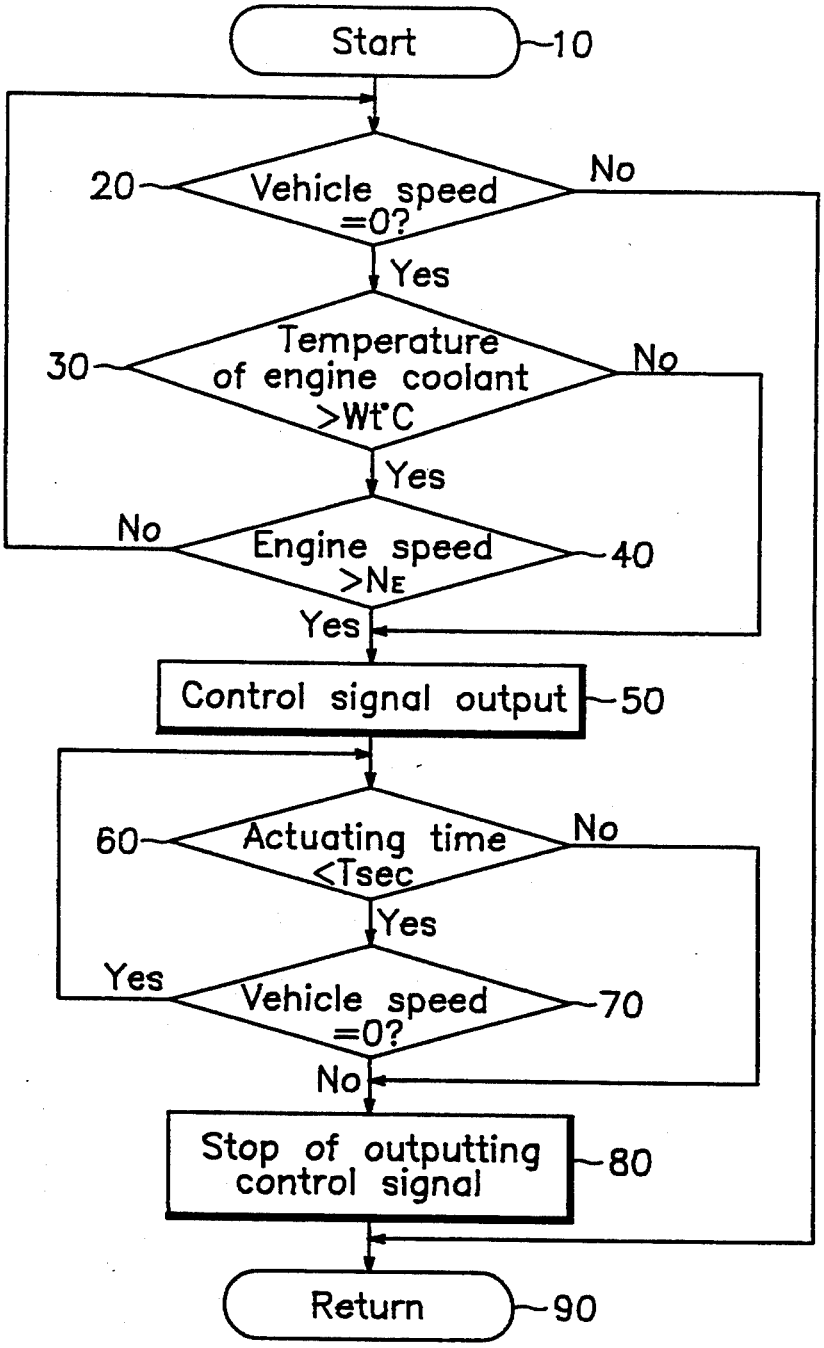
FIG. 2 depicts the steps in the operation of the automatic idling-up controlling device in accordance with the preferred embodiment of the present invention.

The operation of the controller 1 is described with reference to FIG. 2.

If an action of the controller 1 starts (10), the controller 1senses a speed of a vehicle, by means of an electrical signal corresponding to the speed of the vehicle in the vehicle speed sensor 2, and the controller 1 judges a vehicle speed, i.e. whether the speed of the vehicle is "0" (20).

If the speed of the vehicle is not "0" and the vehicle runs at the vehicle speed reading stage 20, a step necessary for warming-up action of the vehicle is not taken, and the stage returns to a main program 90.

However, if the engine starts and before the vehicle starts to run, i.e. the vehicle speed is "0", the stage transfers into an engine coolant temperature reading stage 30 for judging a temperature of the engine coolant.

In the engine coolant temperature reading stage 30, the controller 1 reads a signal according to the temperature of the engine coolant that the coolant temperature sensor 3 senses, and compares the temperature with a given coolant temperature (Wt°C.).

If the engine coolant temperature that the coolant temperature sensor 3 senses is lower than the given coolant temperature (Wt°C.), in the controller 1, since the engine is not heated to a suitable temperature, the controller 1 comes to a driving signal-output stage 50 in order to raise the engine coolant temperature.

The controller 1 outputs a driving signal to the actuator controller 5 to control the movement action of the plunger of the fuel injection pump 6. The opening degree of the outlet of the fuel injection pump 6 is increased according to the action of the plunger, and the fuel quantity injected to the inside of the cylinder is increased. Therefore, the rotation frequency of the engine is more increased, and the rising operation of the engine coolant temperature may be accelerated.

If the engine coolant temperature is higher than the given coolant temperature, since the engine is heated to a suitable temperature, the controller 1 comes to an engine rotation frequency reading stage and compares a predetermined rotation frequency Ne of the engine.

The rotation frequency Ne of the engine is a frequency of the engine more than an usual idling rotation that can rise generally when the driver operates the accelerating pedal at the vehicle's being at a standstill. Thus, in the engine rotation frequency reading stage 40, if the present rotation frequency of the engine is smaller than the predetermined rotation frequency Ne of the engine, the controller 1 determines the state as that the driver does not operate the accelerating pedal for accelerating the warming-up action of the engine during the vehicle's idling rotation state.

Therefore, the controller 1 comes to the vehicle speed reading stage 20 for sensing the speed of the vehicle, and returns to the main program 90, if the vehicle starts to run and the running speed of the vehicle is not "0".

If the vehicle is at a standstill not being at a running state, the controller 1 repeats the abovementioned actions and so that the engine rotates in the idling rotation state.

After the warming-up action, if the driver operates the accelerating pedal in order to accelerate the warming-up action of the engine, without perceiving that exactly, the present engine rotation frequency is larger than the given engine rotation frequency Ne. Thus, the controller 1 comes to the driving signal output stage 50 to output a control signal for operating the actuator controller 5.

The action of the actuator controller 5 formed of solenoid is variable according to a control signal output from the controller 1. The fuel quantity injected into the cylinder of the engine is increased by controlling the movement of the plunger that regulates the opening degree of the outlet of the fuel injection pump 6 to increase the rotation frequency of the engine thereby.

Therefore, in order to reduce the sudden difference between the engine rotation frequency at the time of the idling rotation and the engine rotation frequency increased when the accelerating pedal is operated, the rotation frequency of the engine at the time of the idling rotation is increased. by operating the actuator. The imperfect combustion of the vehicle fuel generated by the rotation frequency of the engine increased abruptly is reduced such that a noxious gas that causes an air-pollution may be minimized.

If the fuel quantity injected into the inside of the cylinder of the engine is increased in accordance with the operation of the actuator controller 5, the controller 1 comes to a time reading stage 60 and counts an operation time of the actuator controller 5 to compare it with a given operation time Tsec.

If the operation time of the actuator controller 1 is shorter than the given time Tsec, the controller 1 comes to a vehicle speed signal sensing stage 70 and determines whether the running speed of the vehicle is "0" or not. That is, the controller 1 determines whether the vehicle starts to run after the engine starts. Accordingly,, if the running speed of the vehicle is not "0", with being increased gradually for driving of the vehicle in the vehicle speed. sensor 2, the controller 1 comes to a driving signal output stop stage 80, and returns to the main program (90), after the controller 1 stops to output a control signal applied to the actuator controller 5.

After the completion of the warming-up action of the engine,, a driving signal applied to the actuator controller 5 stops to be output, and a predetermined fuel quantity is applied to the inside of the cylinder of the engine such that the idling rotation of the engine is performed, in order to save the fuel.

If the warming-up time of the engine is shorter than the predetermined time Tsec in the operation time reading stage 60 and a signal corresponding to the vehicle speed is not perceived in the vehicle speed signal sensing stage 70, i.e. the vehicle does not start, the controller 1 ceaselessly accelerates the warming-up action of the vehicle until the predetermined. time Tsec, and then returns to the main program 90.

As the effects of the present invention, since the warming-up action of the engine is automatically accelerated by sensing the engine coolant temperature at an initially-setting stage of the vehicle, and the time for warming the engine up is more reduced than the time for warming the engine up by passive action of a driver. The warming-up action is automatically halted during the vehicle's running and converted to an idling rotation. Thus, there can be prevented the waste of fuels by the warming-up action and by unnecessary warming-up action and excessive warming-up actions.

The imperfect combustion of the engine generated when the driver operates the accelerating pedal to accelerate the warming-up action, is reduced, and the noxious gas produced by the imperfect combustion can be reduced to prevent an air-pollution.

In addition, because another separate actuator is not necessary in order to embody the present invention, the production cost can be saved.

What is claimed is:

1. An automatic idling-up controlling device of an engine comprising:

a vehicle speed sensing means for sensing a running speed of a vehicle and producing a corresponding signal;

engine coolant temperature sensing means for sensing an engine coolant temperature and producing a corresponding signal;

engine rotation frequency sensing means for sensing a rotation frequency of an engine;

a controller connected to said vehicle speed sensing means, engine coolant temperature sensing means and engine rotation frequency sensing means and producing a control signal to increase an injected quantity of a fuel, if a warming-up action is necessary, by determining a state of the engine by means of an engine coolant and an engine rotation frequency when the vehicle is halted and;

actuator controlling means connected to said controller and varying by a controlling signal applied to said controller to vary a quantity of a fuel injected to an inside of a cylinder of the engine.

2. A method for automatically controlling an idling-up of an engine comprising the steps of:

reading whether a running speed of a vehicle is "0" or not and reading whether an engine coolant temperature is higher than a given temperature;

outputting a controlling signal for operating an actuator controlling means when a running speed of a vehicle is "0" and an engine coolant temperature is lower than a given temperature;

outputting a controlling signal for operating an actuator controlling means when a rotation frequency of the engine is larger than a given value of an engine rotation frequency, after reading whether the rotation frequency of the engine is larger than the given value of the engine rotation frequency, if the engine coolant temperature is higher than a given temperature; and halting an operation of the actuator controlling means when an operation time of the actuator controlling means is longer than a given time, and operating the actuator controlling means till the running speed of the vehicle is not "0" when the operation time of the actuator controlling means is shorter than the given time.

* * * * *